US005730438A

United States Patent [19]

Webb et al.

[11] Patent Number: 5,730,438

[45] Date of Patent: Mar. 24, 1998

[54] REPRODUCTION APPARATUS WITH LOWER PEAK POWER REQUIREMENT WITH INTEGRAL BATTERY POWERED STAPLING AND LOW POWER RECHARGING SYSTEM

[75] Inventors: Douglas E. Webb, Fairport; Frederick B. Clark, West Henrietta; James L. Pratt, Penfield; Douglas W. Buch; Kevin M. Carolan, both of Webster, all of N.Y.

[73] Assignee: Xerox Corporation, Stamford, Conn.

[21] Appl. No.: 755,939

[22] Filed: Nov. 25, 1996

[51] Int. Cl.[6] ..... B27F 7/36

[52] U.S. Cl. ..... 270/58.08

[58] Field of Search ..... 270/58.08

[56] References Cited

U.S. PATENT DOCUMENTS 5,094,379 3/1992 Hoyer et al. ..... 227/2

5,187,534 2/1993 Iwata et al. ..... 270/58.08

OTHER PUBLICATIONS

Xerox Disclosure Journal vol. 21, No. 4, Jul./Aug. 1996, p. 249, By: Webb, Clark & Pratt Title: "Convenience Stapler with Rechargeable Battery".

*Primary Examiner*—David A. Okonsky

[57] ABSTRACT

A copier or printer connecting with a standard commercial electrical power line source and having a limited peak power consumption can still provide an electrically powered sheet stapling system by driving the stapler from an electrical storage battery power supply, the batteries of which are electrically connecting with an integral low voltage electrical power supply of the reproduction apparatus only for low power slow recharging. The stapler is operable for stapling sheets, powered solely by the storage batteries, even when the copier or printer, including its integral low voltage electrical power supply, is completely turned off, i.e., fully disconnected from the power line source. This stapler can also be operated when the reproduction machine is fully operating at its peak power consumption, including the operation of other, internal, stapling, because this stapler's operation does not increase that peak power consumption. Preferably this stapler and its battery power supply is part of an easily unplugable modular unit removably mountable on top of the machine for convenience stapling. Additionally, the stapler may be automatically prevented from further attempted stapling and thus further battery discharge when there is insufficient remaining battery power for fully effective stapling.

4 Claims, 4 Drawing Sheets

REPRODUCTION APPARATUS WITH LOWER PEAK POWER REQUIREMENT WITH INTEGRAL BATTERY POWERED STAPLING AND LOW POWER RECHARGING SYSTEM

The embodiment herein discloses a reproduction machine with a lower or not increased peak electrical power requirement yet providing an integral stapling system for stapling sets of printed reproduction or other sheets, in which the stapler driver is not driven by line power or directly from the machine power supply but rather by an integral storage battery power supply, which integral storage battery power supply is only trickle recharged from the machine power supply, drawing only a small amount of electrical power at any given time, so as not to substantially increase the maximum electrical power consumption of the reproduction apparatus and/or require upgrading the customer site electrical power connection to a special power source or outlet.

An additional or optional feature disclosed in the embodiment here is that, desirably, the stapler battery power supply is only so recharged when the machine is turned on, yet the stapler continues to be usable and operate for stapling long after the machine is turned off, for as long as there is sufficient remaining storage battery power. A further disclosed feature is to automatically prevent further discharge of the stapler battery power supply by attempted operation of the stapler when there is insufficient remaining battery charge for effective stapling.

The de facto or practical peak electrical power consumption limit for copiers and printers in a particular customer site or location is a significant limitation. It is especially limiting in some countries which have more restricted or less reliable site available line current or voltages. It is especially a problem for small or medium size copiers or printers for home or ordinary or small offices use intended to be connected to existing ordinary home or office outlets, and/or to lines which may be shared with other office equipment. In some cases this has effectively prevented sale or operation of on-line stapling systems and/or convenience staplers during copying or printing operations of the machine, and/or restricted increased printing rates. The use of the convenience stapler may even be restricted to only those times in which the reproduction machine is turned on but is in a low power mode rather than a normal operating mode. Furthermore, there are increasing government and private restrictions or regulations on applying to or drawing power or current from commercial electrical lines in transients such as pulses or sharp peaks, since that can sometimes affect other electronic or electrical equipment.

A summary of information from these same inventors on this same subject was recently published in the July/August 1996 issue of the *Xerox Disclosure Journal*, Vol. 21, No. 4, at page 249. The full text thereof is copied immediately below as follows:

"It is well known to provide externally accessible electrically driven convenience staplers on copiers and printers. They allow manual inserting, for stapling or re-stapling, of a set of original documents or a set copy sheets on or in the machine or an associated sorter, finisher or the like. Such convenience staplers may be in addition internal staplers for on-line finishing. See, e.g., Xerox Corp. U.S. Pat. No. 5,094,379, and its cited references. That patent also teaches partially shared power supplies with time delay avoidance of overlapping power usage of the two staplers, to reduce peak or maximum power consumption when the staplers solenoid drivers or drive motors are operated. Independent commercial battery operated staplers are also known.

It is suggested here to reduce maximum or peak line power consumption of the machine and/or line transients by providing a self contained rechargeable battery and to use the battery output to drive of one or more staplers on or in the machine, with relatively slow or trickle recharging of that battery from the copier or printer power supply when the machine is on. Thus, the stapler drive pulses will not add to the total machine power consumption and cause it to exceed the desired line current draw limit. The stapler may be used at time, even when line power is turned off or removed from the machine, as long as the battery charge lasts. This convenience stapler may comprise a removable and/or repositionable stapler module with an integral battery pack and recharger with only a low voltage connection to the machine for said recharging.

To enable use of existing lower voltage DC power supplies in the machine for such charging, there may be two or more such batteries, charged in parallel, but discharged in series to drive the stapler."

A specific feature of the specific embodiment disclosed herein is to provide a reproduction apparatus for printing sheets, said reproduction apparatus having an integral low voltage electrical power supply, said reproduction apparatus including said integral low voltage electrical power supply being powered by a standard commercial electrical power line source through a disconnectable line power connection, said reproduction apparatus having a preset limited peak power consumption from said electrical power line source when said reproduction apparatus is fully operational, and said reproduction apparatus having an electrically powered sheet stapling system; the improvement comprising an electrical storage battery power supply electrically connecting with said electrically powered sheet stapling system to drive said electrically powered sheet stapling system from said storage battery power supply without substantially increasing said limited peak power consumption of said reproduction apparatus, said storage battery power supply electrically connecting with said integral low voltage electrical power supply of said reproduction apparatus only for low power slow recharging of said storage battery power supply.

Further specific features disclosed in the embodiment herein, individually or in combination, include those wherein said electrical storage battery power supply is integral said electrically powered sheet stapling system, and said electrically powered sheet stapling system is operable for stapling sheets powered by said storage battery power supply even when said reproduction apparatus, including said integral low voltage electrical power supply, is disconnected from said electrical power line source; and/or wherein said storage battery power supply comprises plural batteries connected to be recharged in parallel by said integral low voltage electrical power supply and connected in series to drive said electrically powered sheet stapling system; and/or wherein a control system is electrically connected with said storage battery power supply to determine if said storage battery power supply has insufficient power to effectively operate said electrically powered sheet stapling system and to automatically disable said electrically powered sheet stapling system from further attempted stapling in response thereto until sufficient said power is restored, to prevent further discharge of said storage battery power supply by attempted stapling with said electrically powered sheet stapling system.

The disclosed system may be a stand-alone system with its own internal electrical controls, which may be implemented partially or fully in standard components and hardware, using standard circuits or single chip VLSI designs. As to these and other components of the subject apparatus, or alternatives therefor, it will be appreciated that, as is normally the case, various such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

Figure 1:
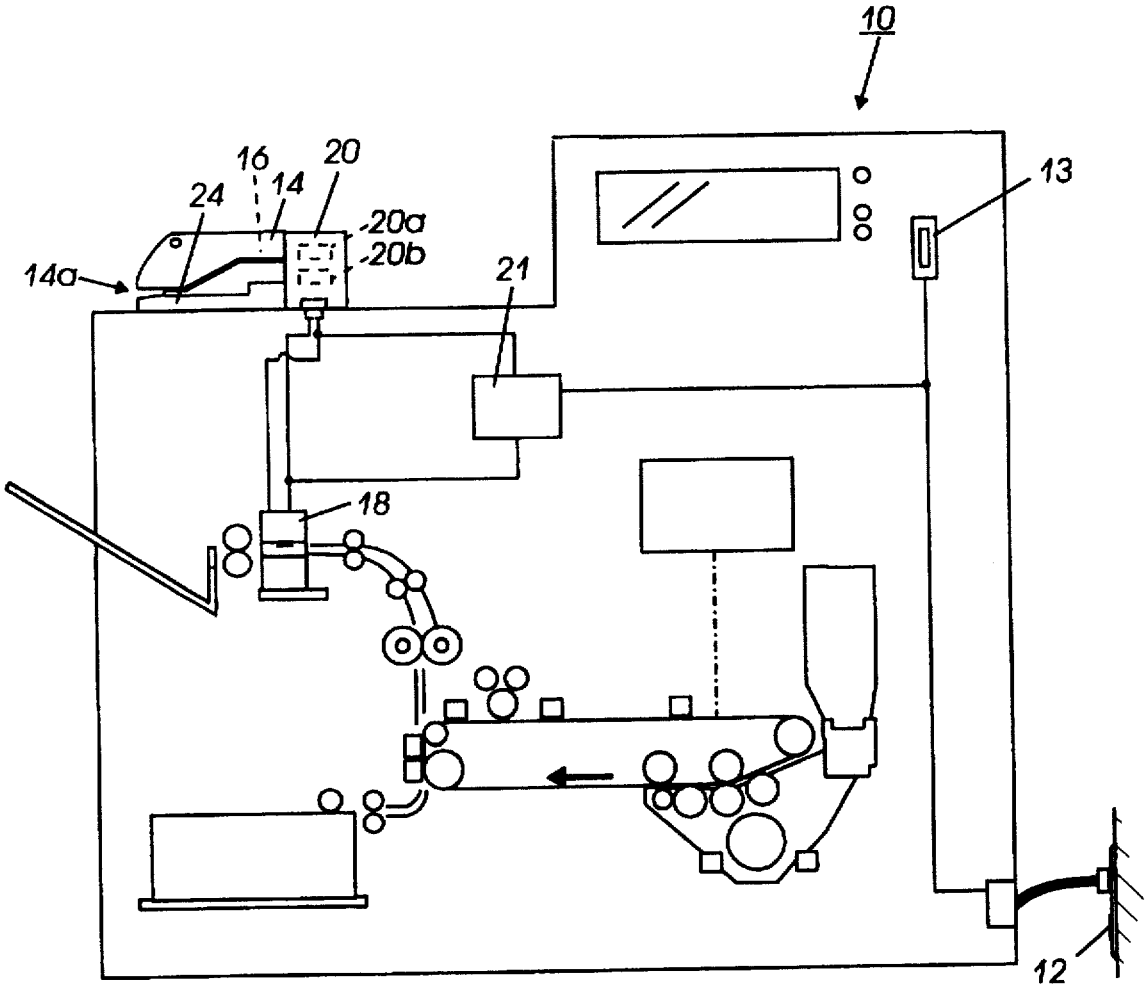
FIG. 1 is a schematic frontal view of one embodiment of the disclosed battery powered stapling system in an otherwise conventional reproduction apparatus.
Figure 4:
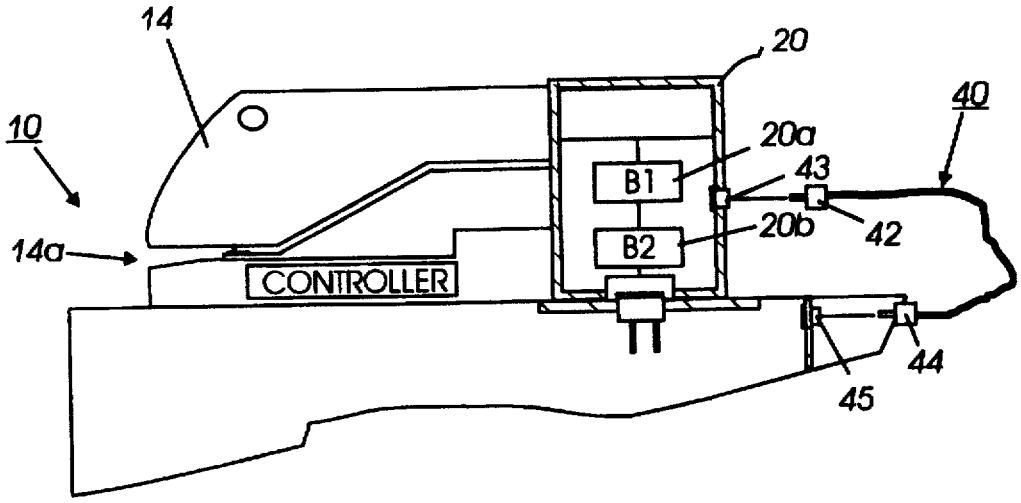
Figure 5:
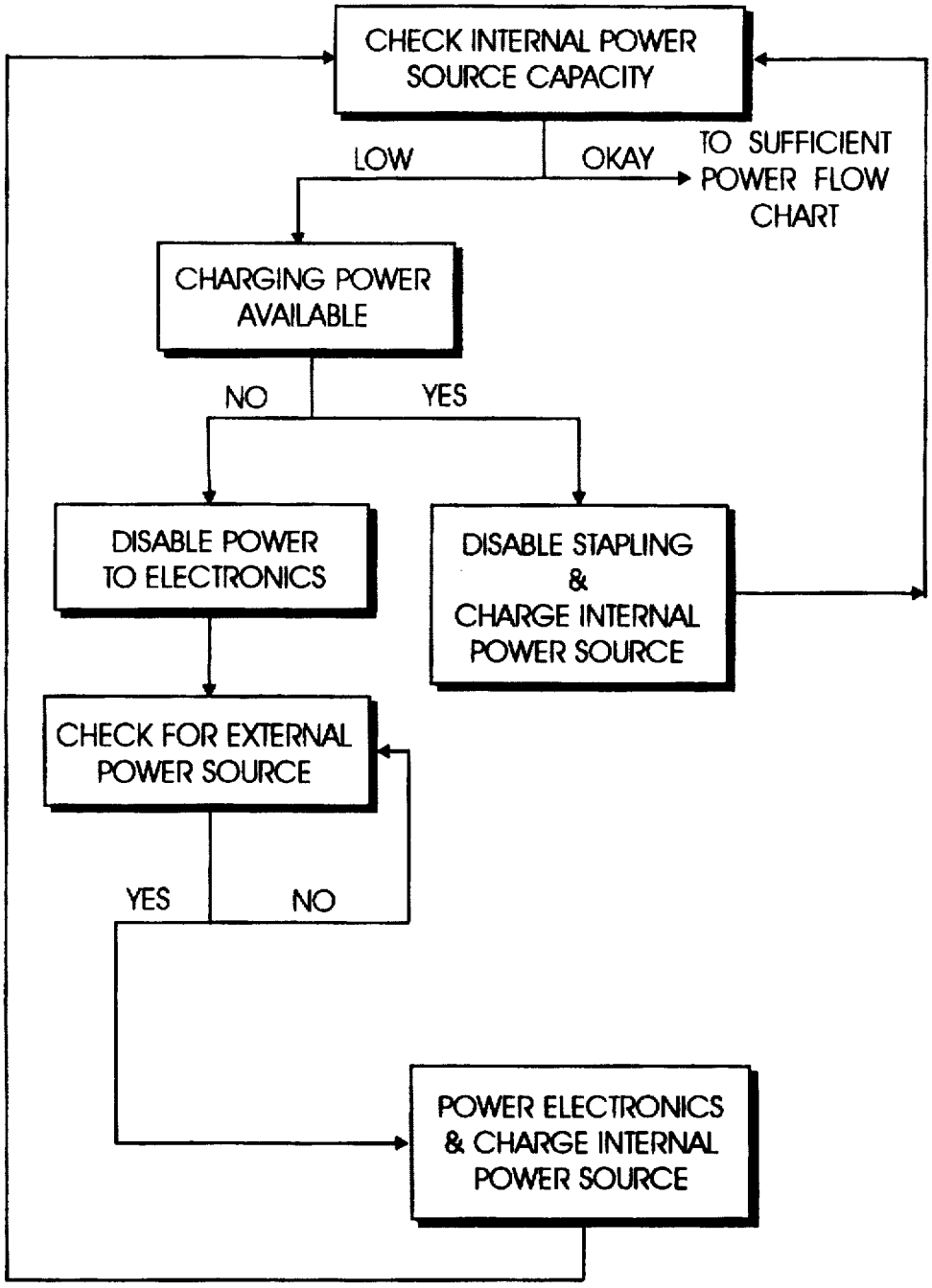

FIG. 4 is a an enlarged and partially cross-sectional schematic view of the exemplary stapling module of FIG. 1; and FIG. 5 is a flow chart or schematic circuit drawing of an additional battery power saving and recharging time improvement feature wherein the stapler is automatically disabled from further attempted stapling (and that may be so indicated by turning off a ready light on the stapler unit), if the storage battery or batteries lack sufficient remaining electrical storage power for effective stapling. As shown, this may be accomplished by monitoring and sensing a preset low battery voltage level, e.g., a level at which it has been predetermined that there would be insufficient battery power for the stapler driver motor to drive a staple through a preset maximum sheet set size or thickness.

Figure 2:
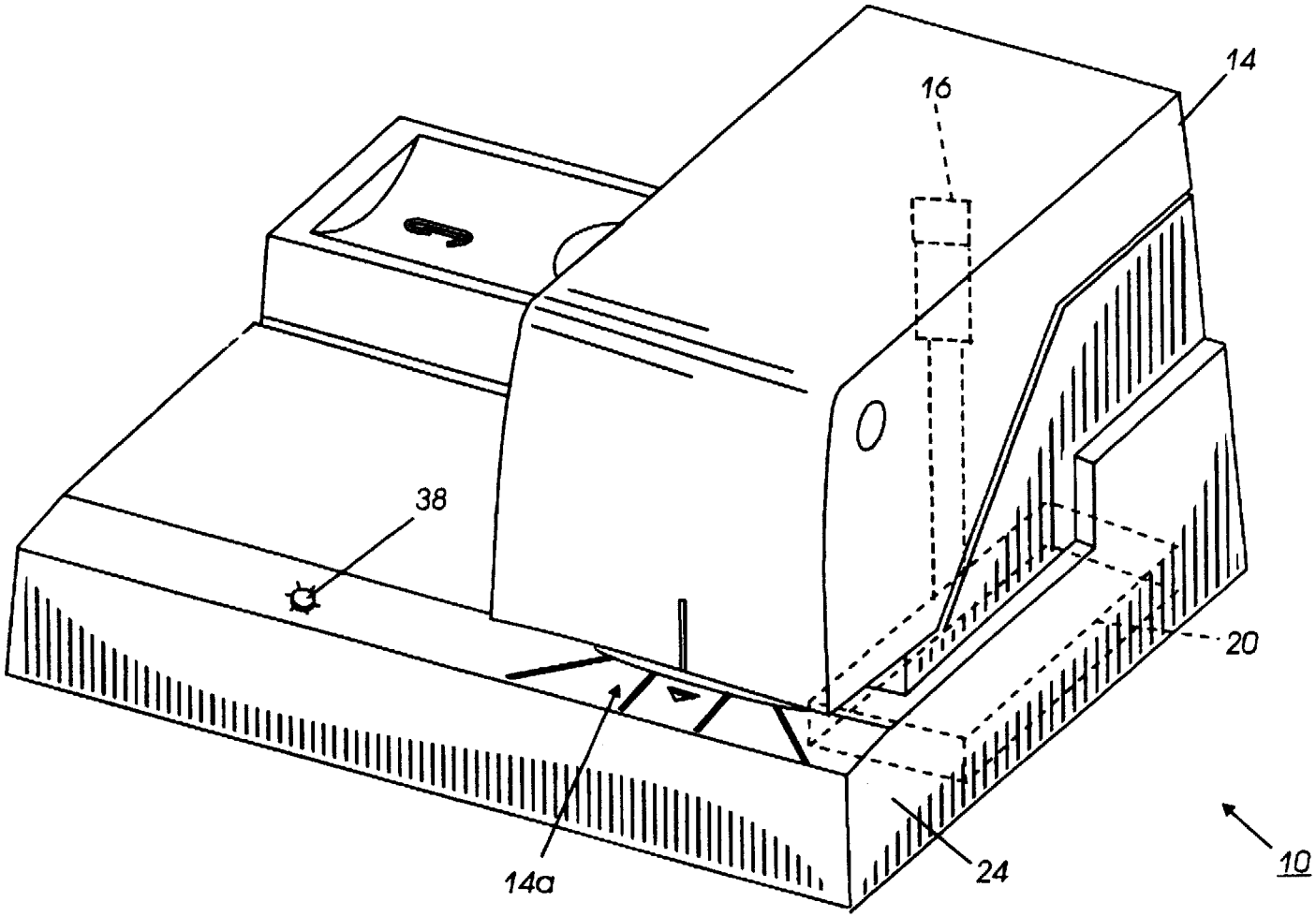
FIG. 2 is a an enlarged partial perspective view of the exemplary stapling module portion of FIG. 1.

Describing now in further detail this exemplary embodiment with reference to the Figures, there is shown in FIG. 1 an otherwise conventional reproduction apparatus or machine 10, connected to an ordinary electrical power line 12 via a normal electrical connector plug in an ordinary outlet, via a normal on-off power switch 13, merely by way of one example. An externally accessible convenience stapler unit 14, preferably in a modular unit as shown enlarged in FIG. 2, is mounted externally to the machine 10 in a convenient location for insertion of sheets of paper into the stapler jaws for stapling, in a conventional manner. Conventionally, the inserted sheets actuate a switch 14*a* in the stapler 14 stapling jaws, which applies electrical power to a staple driver motor coil 16 (or solenoid, depending on the stapled in the stapler unit 14, to staple the set of sheets together. Since the stapler motor must provide sufficient force and power to drive a staple through a number of sheets of paper and then clinch the staple, a substantial electrical power pulse must be briefly applied to this motor 16 coil, several amperes of current if low voltages are desired for safety.

It will be appreciated that the convenience stapler 14 may, in some machines, be in addition to another, internal, stapler providing on-line stapling of the sets of printed sheets being outpuffed. Note, for example, the descriptions in the above-cited U.S. Pat. No. 5,094,379. Since the present system may optionally be used for driving one or both staplers in such cases, or alternating therebetween, such a second stapler is illustrated here in phantom at 18.

Here, a battery power supply 20, which may consist of one or more conventional rechargeable storage batteries, here 20*a* and 20*b* (additionally labeled B1 and B2 in FIG. 4), is provided for operating the stapler 14 motor 16. The effective driving power for the stapler 14 here is from this battery supply 20, not from the machine 10 power supply. These batteries 20*a* and 20*b* are only recharged by "trickle" charging from the existing or otherwise conventional low voltage, e.g., 24 volt, machine power supply 21 of the reproduction apparatus 10. Preferably, the battery set 20 recharging is continuous from machine power supply 21 while the machine 10 is turned on, but at a very low rate, and only as long as the machine 10 is turned on. This is transparent to the operator and is an insignificant additional power or current draw on the machine 10 or its connecting power line 12, e.g., 3 watts or less. Thus, it also does not interfere with or significantly add to the power requirements of any other, internal staplers in the machine 10 such as exemplary output stapler 18 in FIG. 1. If desired, this internal stapler 18 can also be operated from the same, or another, battery pack. That is, if an internal stapler such as 18 is provided, another option is to also drive the motor or solenoid of that stapler 18 from the same battery pack 20 when it is available.

The battery set 20 recharging process here draws so little power from the existing machine 10 low voltage power supply 21 that no new power supply is required, and there is no substantial effect on the total peak power consumption of the machine 10 even if recharging occurs during peak power operating consumption of the machine 10. Thus, there is no need for this recharging to be interrupted even under machine 10 peak power consumption conditions.

The stapler 14 and its battery power supply 20 may desirably be an integral or self contained and removable unit, normally mounted in a base stand 24 as in FIG. 2 and/or a mounting recess integral the top (:or side) of the machine 10. When in that mounting position, as shown in FIG. 4, a simple low voltage cable connection 40 can be made by plugging the cable 40 plug 42 into female connector 43 in the stapler unit 14 and its other end plug 44 into a machine 10 base female plug 45 connecting with low voltage power supply 21. Alternatively, a conventional low voltage male plug on the stapler 14 unit base may plug into a low voltage female connection on the base stand or mounting recess 24 of the machine 10 so as to automatically connect to recharge the integral battery pack in the stapler, as schematically shown in FIGS. 1 and 4. Suction cups or other stapler operation vibration damping or isolation may be provided between the stapler unit 14 and the machine 10 in the mounting base or stand 24.

Figure 3:
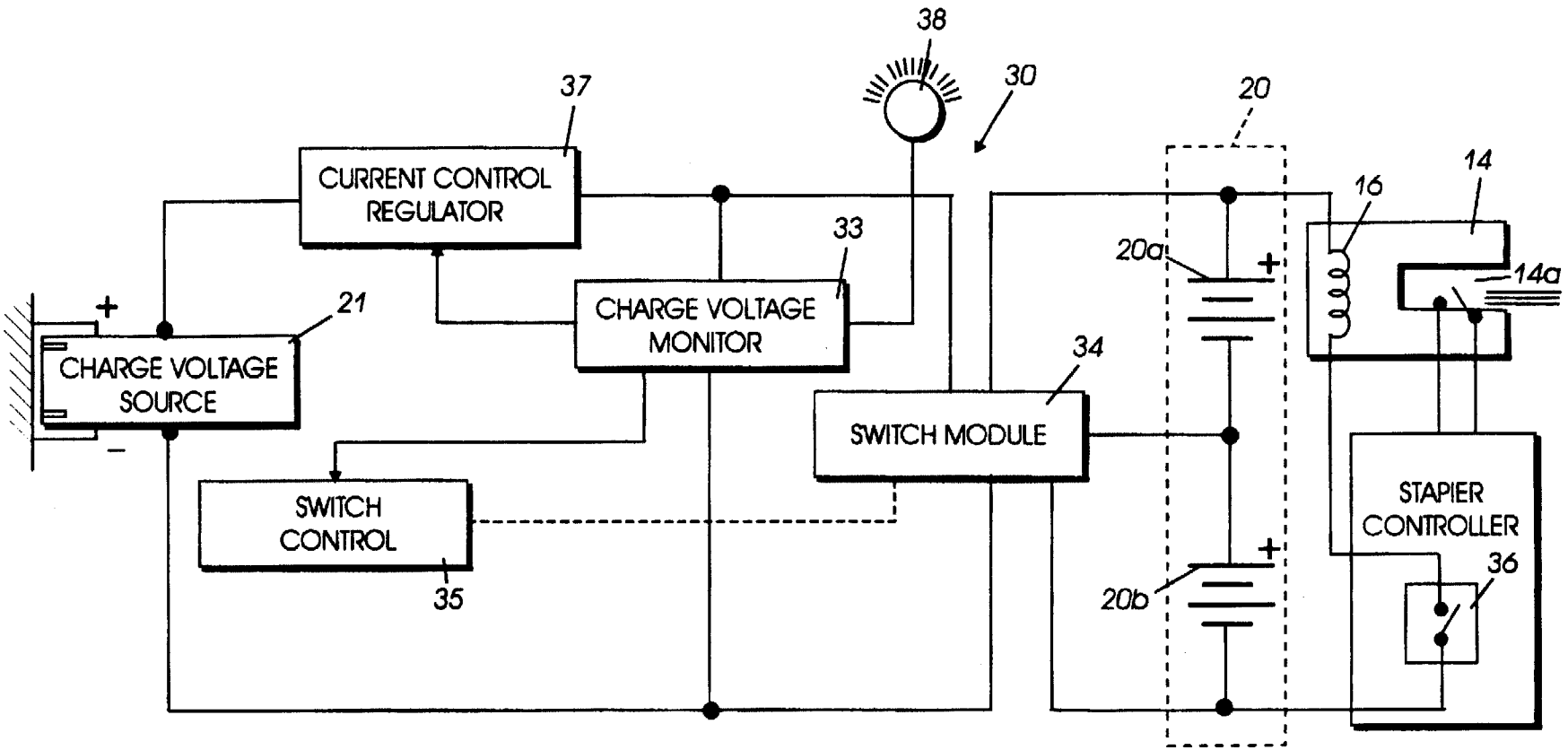
FIG. 3 is one schematic example of a recharging and operating circuit for the exemplary stapling module of FIGS. 1 and 2.

As an additional optional feature, of which one example thereof is the circuit 30 shown in FIG. 3, the two batteries 20*a*, 20*b*, may be connected in series to drive stapler 14 motor coil 16, thus applying twice the individual battery voltages when the staple actuator switch 14*a* is actuated. Yet, as shown, in the circuit 30 these same two batteries 20*a* and 20*b* here may be desirably recharged by trickle charging them in parallel (and/or sequentially alternatively). This allows recharging connection to a lower voltage power supply such as 21 than if the batteries were recharged in series. The circuit 30 may also be integral the stapler 14 unit or module. It may use any of various known electronic components. In the example of FIG. 3, alternate parallel charging of only one battery at a time is provided by a switch module 34 operated by a switch control 35 controlled by a charge voltage monitor 33. The charge voltage monitor 33 can also be used to prevent overcharging by connection as shown to a recharging current control regulator such as 37, in a well known manner.

The FIG. 3 charge voltage monitor 33 or other such monitor can also monitor the currently remain. ing total battery charge, by sensing its voltage level, and operate a stapler disabling switch 36 when there is insufficient battery power left to effectively operate the stapler 14, and attempts to use the stapler further would only run the batteries down further. FIG. 5, described above, illustrates one example of this feature in further detail. The monitor 33 can also operate a lighted visual display 38, such as an LED, as shown in both FIGS. 3 and 2, to indicate that (when) the stapler can be used.

An additional feature here is that, desirably, the stapler's battery power supply 20 recharging need only be done when and while the machine 10 is turned on, such as by the machine 10 main power switch 13, so that the machine 10 does not need to draw any line power when it is turned off. Yet, here, the stapler 14 can continue to be usable for stapling long after the machine 10 is turned off, completely independent of any machine 10 power, in fact, for as long as there is sufficient remaining storage battery 20 power to drive the stapler 14. This is unlike a conventional reproduction machine stapler which can only be operated by turning the machine on.

As described above, the FIG. 3 and FIG. 5 or other battery charging control systems can be variously implemented with off the shelf or existing power supply and/or other electrical components as will be well known to power supply designers. For example, for controlling the charging of two 12 volt lead-acid batteries in series from the internal machine 24 volt source, a single microprocessor microcontroller can be tied to the operative components, which microprocessor has an integral pulse width modulation (PWM) and analog to digital converter to provide both constant current charging and constant voltage charging, where the microprocessor's PWM is low pass filtered and tied to the control voltage input of the charge pump, and the analog to digital converter is used to measure the voltage drop across a series resistor to update the PWM. AJso, the microprocessor can be programmed as described above to detect when the battery voltage is not high enough for stapling, and, optionally, to detect when the 24 volt recharging power source is not on or not connected and terminate stapler operation after a preset time period thereafter, such as two hours. It can also be used to control the initial voltage applied to the stapler motor when the stapler is initially starting to operate in a known manner to minimize an initial inrush of current thereto and the associated mechanical kick, and to avoid exceeding a 150 ma maximum draw from the 24 volt power source.

While the embodiment disclosed herein is preferred, it will be appreciated from this teaching that various alternatives, modifications, variations or improvements therein may be made by those skilled in the art, which are intended to be encompassed by the following claims:

We claim:

1. In a reproduction apparatus for printing sheets, said reproduction apparatus having an integral low voltage electrical power supply, said reproduction apparatus including said integral low voltage electrical power supply being powered by a standard commercial electrical power line source through a disconnectable line power connection, said reproduction apparatus having a preset limited peak power consumption from said electrical power line source when said reproduction apparatus is fully operational, and said reproduction apparatus having an electrically powered sheet stapling system; the improvement comprising:

an electrical storage bafiery power supply electrically connecting with said electrically powered sheet stapling system to drive said electrically powered sheet stapling system from said storage batten power supply without substantially increasing said limited peak power consumption of said reproduction apparatus;

said storage battery power supply electrically connecting with said integral low voltage electrical power supply of said reproduction apparatus only for low power slow recharging of said storage battery power supply.

2. The reproduction apparatus of claim 1, wherein said electrical storage battery power supply is integral said electrically powered sheet stapling system, and said electrically powered sheet stapling system is operable for stapling sheets powered by said storage battery power supply even when said reproduction apparatus, including said integral low voltage electrical power supply, is disconnected from said electrical power line source.

3. The reproduction apparatus of claim 1, wherein said storage battery power supply comprises plural batteries connected to be recharged in parallel by said integral low voltage electrical power supply and connected in series to drive said electrically powered sheet stapling system.

4. The reproduction apparatus of claim 1, wherein a control system is electrically connected with said storage battery power supply to determine if said storage battery power supply has insufficient power to effectively operate said electrically powered sheet stapling system and to automatically disable said electrically powered sheet stapling system from further attempted stapling in response thereto until sufficient said power is restored, to prevent further discharge of said storage battery power supply by attempted stapling with said electrically powered sheet stapling system.

* * * * *